United States Patent [19]

Meshberg

[11] 4,271,875

[45] Jun. 9, 1981

[54] DISPENSER ADAPTED FOR FAST PRESSURE FILLING

[76] Inventor: Philip Meshberg, 2500 S. Ocean Blvd., Bldg. 3, Apt. 1-A, Palm Beach, Fla. 33480

[21] Appl. No.: 68,429

[22] Filed: Aug. 21, 1979

Related U.S. Application Data

[63] Continuation-in-part of Ser. No. 944,401, Sep. 21, 1978, abandoned.

[51] Int. Cl.[3] ..... G01F 11/02; B65D 83/14

[52] U.S. Cl. ..... 141/3; 141/20; 222/385; 222/402.16; 222/402.24

[58] Field of Search ..... 222/1, 321, 280, 383, 222/385, 402.16, 402.24, 518; 141/3, 20

[56] References Cited

U.S. PATENT DOCUMENTS

| | | | |
|---|---|---|---|
| 2,890,817 | 6/1959 | Rheinstrom | 222/402.16 |
| 3,158,298 | 11/1964 | Briechle | 222/518 |
| 3,331,559 | 7/1967 | Fedit | 222/321 |
| 3,441,117 | 4/1969 | Treharne, Jr. | 222/402.16 X |
| 3,651,997 | 3/1972 | Venus, Jr. | 222/402.16 |
| 4,061,247 | 12/1977 | Meshberg | 222/1 |

FOREIGN PATENT DOCUMENTS

| | | | |
|---|---|---|---|
| 2206079 | 12/1973 | Fed. Rep. of Germany | 222/402.16 |
| 1076329 | 7/1967 | United Kingdom | 222/402.16 |
| 1287126 | 8/1972 | United Kingdom | 222/402.16 |
| 1362885 | 8/1974 | United Kingdom | 222/402.16 |

*Primary Examiner*—David A. Scherbel
*Attorney, Agent, or Firm*—Kenyon & Kenyon

[57] ABSTRACT

A pressurized dispenser including a container, a mounting cup having a central opening therein, said mounting cup attached to said container, a dispensing means comprising a body member forming a tank and having an open top portion with a dispensing stem projecting therefrom through said central opening in said mounting cup, said body retained in said mounting cup, and a diaphragm interposed between said body and said mounting cup, sealing around said projecting stem at least when said stem is in an unoperated position, a passageway is formed in the body extending across the top of said body and through the body, the passage in communication with the tank in the area below the diaphragm, an annular gasket is interposed between the mounting cup and container, the gasket having an opening with the same profile as the outside of the body disposed so as to seal against the body to interrupt communication between the passageway and container, so that, during pressure filling, when pressure medium is supplied to the area of the tank below said diaphragm it flows across the top of the body and through the body to the gasket, deforms the gasket away from the side of said body permitting flow into said container at a fast rate.

25 Claims, 9 Drawing Figures

DISPENSER ADAPTED FOR FAST PRESSURE FILLING

This application is a continuation-in-part of application Ser. No. 944,401, filed Sept. 21, 1978, now abandoned.

BACKGROUND OF THE INVENTION

This invention relates to pressurized dispensers in general and more particularly to a dispenser construction which permits increased speed in pressure filling.

Generally, pressurized containers comprise a can or bottle containing the material to be dispensed along with a pressurizing fluid, either an aerosol valve, or a pump, and a mounting cup by means of which the valve or pump is mounted on top of the can or bottle. Generally, in a valve type arrangement, there is pressure filling with a liquid propellent, whereas in a pump type arrangement, nitrogen or compressed gas is used. Typically, in a valve type arrangement an aerosol valve is crimped onto the mounting cup with a diaphragm disposed between the top of the valve body and the mounting cup. This diaphragm seals around the valve stem, which is depressed downward for dispensing, along with sealing at the top of the valve body.

In general, two types of aerosol valves are in common use. There are a metering valve and a non-metering valve. The construction of the metering valve is such that a chamber is formed in the valve body. The chamber is of a size to hold a metered dose of the product to be dispensed. When the valve is in an unoperated position, the tank formed in the valve body is placed in communication with a dip tube extending to the bottom of the can and the tank is filled with the product to be dispensed under pressure. Upon the depression of the valve stem, the inlet from this dip tube and, thus from the container, is closed off and an outlet through the upper part of the stem is then opened. The material under pressure in the tank is forced out through the dispensing outlet. In a non-metering valve, on the other hand, the tank is always in communication with the dip tube and thus with the container. As a result, depressing the valve to place the outlet in communication with the tank provides for a continuous supply of material to be dispensed.

Generally, there are two methods of getting the propellant into the container. One type is cold filling in which the propellant is maintained in liquid condition by being cooled and is filled into the container in that manner. This, of course, requires special refrigeration equipment to maintain the container and the propellant at a low temperature until the mounting cup and the valve therein can be crimped in place on top of the container. Cold filling is not at all practical in some cases. For example, when using hydrocarbon propellants, which have become more common due to the problems caused by fluorocarbons, cold filling presents significant dangers. Because a certain amount of the propellant will escape during cold filling, a collection of hydrocarbon such as butane in the air can result and can cause an explosive danger.

The other method of filling is known as pressure filling. In this method of filling the propellant is forced into the container, generally through the dispensing outlet in the valve stem. The rate of dispensing from the valve is normally controlled by an orifice or outlet port in the stem. Generally, this orifice is small. This places a limit on the filling rate. A further problem exists, particularly in a metering valve, since when the valve is depressed, at which time it would be possible to force the material under pressure through the valve stem and into the tank, the tank is sealed off at the bottom. One solution to this problem has been to place a cross-cut in the stem which, if the valve is depressed further than it would be in normal operation, bridges the seal at the bottom of the tank to permit the material to flow from the tank and into the container. This solution although workable is still slow because of limitations on the size of the orifice and it requires a more complex construction of the valve stem.

Another solution is that disclosed in British Pat. No. 1,287,126. In this arrangement for pressure filling, openings are made at the top of the valve body at the edges. Normally these holes are covered by the sealing ring or diaphragm at the top of the valve body by means of which the valve is sealed to the mounting cup. In this method of pressure filling the material under pressure, after it reaches the tank, forces its way under the sealing ring and finds its way to the holes whereupon it reaches the container. Although this works reasonably well, there are still limitations on filling speed. In the valve disclosed in the British patent, the valve body is made of metal. Similar construction has been used with plastic. However, in each case the design is such that under normal conditions a seal is formed between the valve body and the mounting cup at the top of the valve body. Some sort of seal is necessary in order to prevent the material under pressure or the propellant from escaping. However, this method of pressure filling is still relatively slow.

Another manner of pressure filling is disclosed in U.S. Pat. No. 2,974,453. In this arrangement, a two piece stem is used. By using a two piece stem, interchangeable upper stem portions become possible. Thus, a stem with a port at its lower end is used for pressure filling, whereas a stem with a port further up is used for dispensing. This, of course, results in increased complexity of the aerosol valve.

In some applications, there is also a need for fast pressure filling in leak proof pump type dispensers such as the type of dispenser disclosed in U.S. Pat. No. 3,211,346. This need exists in the dispensing of products which cannot tolerate the presence of air, which could result in the oxidation of the product. Such is the case with certain sensitive drugs. Conventionally, pumps include means for venting so that, as material is dispensed and removed from the container, the space vacated is filled with air. In this way, ambient air pressure is always available acting on the remaining fluid within the container. However, with any venting system, there is some danger of leaking. Thus, where it is desired to make an absolutely leak proof pump, measures such as that disclosed in the aforementioned patent have been taken. Essentially this comprises making the pump and container airtight and pressurizing the container to a pressure above atmospheric, using nitrogen or the like, so that even when the material in the container reaches a low level, there will still be a pressure equal to or greater than atmospheric pressure to permit refilling the pump chamber.

SUMMARY OF THE INVENTION

The present invention provides a construction which permits faster pressure filling. In the arrangement of the present invention, rather than simply having holes or slots at the edge of the valve body, slots formed in the top of the valve body are always in communication, at their inner ends, with the tank or pump chamber. The slots in the top of the pump body are connected to openings which run the length of the pump body, being formed as slots in its outer surface or as holes passing through the pump body, forming channels which extend from the tank to the gasket. Thus, the diaphragm overlying the tank, and which is between the tank and the mounting cup, no longer seals the top of the tank to the mounting cup. This diaphragm still, however, seals around the valve stem except during pressure filling. To obtain the additional sealing which is necessary, a gasket which surrounds the valve body and which is disposed between the mounting cup and the top of the container is utilized. To a certain extent this gasket acts like a check valve. Because it is supported over a larger area on its top portion by the mounting cup than it is supported against the top of the container, during pressure filling, the medium, i.e., the propellant, entering through the slots in the top of the valve body coming into contact with the gasket pushes it away from the side of the valve body opening a path through which the medium can flow. However, under normal conditions with normal pressure in the container the gasket remains in place against the sides of the container and prevents the propellant and product freely flowing into the valve housing. In order for this gasket to properly seal, a certain number of conditions must be present. The opening in the gasket, which rests against the valve body must be smooth. Furthermore, this opening or hole should match the housing diameter. Any major deviations from this, can, of course, result in leakage. Beyond this, best results are obtained through proper selection of material and its resiliency and proper crimping to a predetermined type of bottle. The gasket should be soft. In one embodiment the gasket had a durometer value of 50 to 70. In general, the durometer required will depend on thickness and diameter of the gasket. The bottle to which it is crimped should have a rolled bead, i.e., there should be no sharp edges. Finally, compression should be controlled during crimping, to be from 10 and 25% depending on the area of the top of the bottle. By controlling these factors during the crimping, the gasket will be pushed inward to make a tight seal with the pump body to insure that the seal is maintained during normal operation.

Pressure filling can be carried out either through the stem only or around the stem only. Preferably, it is done both through and around the stem. During such filling around the stem, the diaphragm flexes down, permitting large amounts of propellant to be quickly filled into the container. As the valve stem is depressed, because there is a small gap between the stem and the mounting cup, material can be forced through this gap pushing the diaphragm downward and away from the stem to let additional material to flow in by that route. Because of the channels, even when the diaphragm is pushed against the top of the pump body, a path to the container still exists through the channels.

For example, with the old pressure filling method, maximum rates of approximately 12 grams per second were obtainable. With the present invention, rates of 30 grams per second or more are possible.

DETAILED DESCRIPTION OF THE INVENTION

Figure 1:
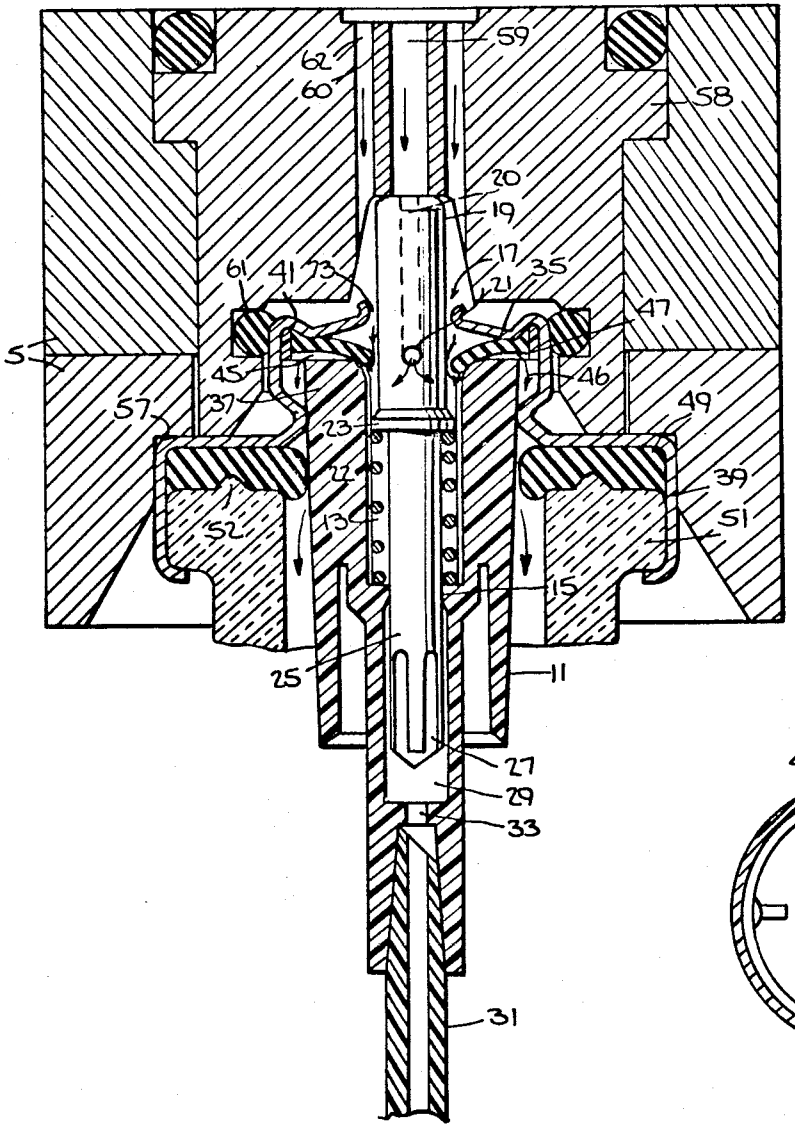
FIG. 1 is a cross-sectional view of a metering valve according to the present invention showing the valve in the pressure filling position with the pressure filling head disposed thereover.

FIG. 1 is a cross-sectional view of a metering valve and mounting cup constructed according to the present invention. The valve includes a valve body 11 in which there is formed a tank 13 of predetermined capacity to permit metering a predetermined amount of material. Movably disposed within the tank and sealing against a throat 15 is a valve stem 17. The valve stem 17 includes an upper portion 19 containing an axial bore 20 which communicates with a radial port or orifice 21. A flange 23 is formed directly below the upper portion 19 of the valve stem. The valve stem has a lower portion 25 which extends through the tank 13 and the bottom of which seals against the sealing throat 15 during operation. A spring 22 acts between the bottom of tank 13 and flange 23 to bias stem 17 outward. The valve is shown in the pressure filling position, with a pressure filling head disposed thereover. In this position, slots 27, formed at the very bottom of the stem portion 25, are below the throat 15 preventing communication between a space below the throat or chamber 29, which is itself in communication with a dip tube 31 through an orifice 33.

A diaphragm 35 surrounds the top portion of the stem 19. The valve, which has an enlarged portion 37 at its top is crimped into a mounting cup 39. The diaphragm 35 is disposed between mounting cup 39 and the top of the valve body 11. The diaphragm 35 is received in a recessed area in the top of the valve body defined by an annular wall 41.

Figure 2:
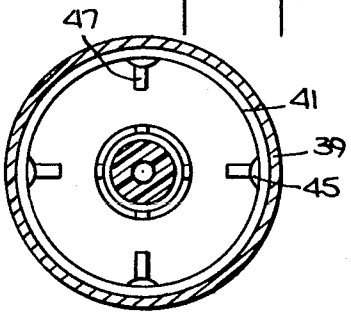
FIG. 2 is a plan view of the top of the valve of FIG. 1.

A plurality of slots 47 are formed in a top portion 43 of the valve body 11. As is evident from FIG. 1, these slots place a plurality of holes 45 directly in communication with the tank 13. As a result, any material reaching the tank during pressure filling can easily reach the holes 45. In the prior art construction, the top portion 43 of the valve body 11 was flat and contained a plurality of holes at the point of intersection of the annular portion 41 and the top portion 43. These were similar to the semiconductor holes 45 visible on FIG. 2 which holes are extended as channels 46 along the enlarged portion 37, visible in FIG. 1. In order to pressure fill with the construction of the prior art, the material thus had to be forced under the seal 35 to reach the holes 45. In the present invention, material flows from the tank 13, through slots 47, holes 45 and channels 46 down to a sealing gasket 49. Normally, gasket 49 seals against the side of the valve body 11. The mounting cup 39 and valve are crimped onto a container 51. The top of the container abuts against gasket 49. The downwardly depending portion 53 of mounting cup seals around the container 51. When crimped in place, the gasket 49 is compressed between the mounting cup 39 and container 51. The compression causes an inward movement causing it to better seal against valve body 11. This is further aided by a projection 52 on the top of the container 51.

In order to obtain proper sealng at this point, a number of conditions must be met. First, the gasket 49 must have an inner surface which is very smooth. Secondly, the hole forming the surface must match the valve body 11, e.g., if the valve body 11 is round, the hole must also be round. Any substantial deviations can result in leakage. Further, the surface on the container, be it a glass bottle as shown, or a metal container, must have smooth surfaces, i.e., not have any sharp edges. Otherwise, cutting of the gasekt would be possible. Finally, the gasket must be selected for the particular application and the crimping pressure controlled to control compression. Typically, gasket materials with a durometer of 50 to 70 should be used and a compression between 10 and 25% achieved, depending on the area of the top of the container 51, the amount of the compression being inversely proportional to the area on top.

Pressure filling head 26 is of conventional design and only the portions of interest to the present invention will be discussed. Basically, the pressure filling head has an outer portion 55 with a step 57 adapted to rest on the top of the mounting cup 39 when the pressure filling head is moved into position. Inserted within the outer portion 55 is an inner portion 58 containing a central opening 59 formed by a tubular member 60 through which the pressure filling fluid is supplied. The opening 59 is in alignment with the bore 20 in the stem 17. Surrounding tubular member 60 is an annular space 62. This central portion includes a sealing ring 61 which seals around the upper portion of the mounting cup 39 when the filling head is in place. The tubular member 60 in the inner portion 58 of the filling head presses down on the valve stem 17 moving the port 21 below the diaphragm 35. In the normal, at rest, position as will be evident from examination of FIG. 3 and the additional figures to be described, the port 21 will be above the lower edge of the gasket 35 so as to prevent communication between the tank 13 and the bore 20 leading to the outside. However, in the position shown, the valve stem 17 is depressed so that the bore 21 communicates with the tank 13. Propellant under pressure is supplied to the opening 59 and the annular space 60 and then flows both through the bore 20, out of the radial port 21, and around stem portion 19, deflecting diaphragm 35, and into the tank 13. It then flows through the slots 47 and holes 45 and then through the channel 46 reaching the upper surface of the gasket 49. The pressure, which is typically approximately 800 psig, and cannot exceed 900 psig, forces gasket 49 away from the sides of the valve body 11. The propellant then pressure fills into the container.

For example, at 800 psig a minimum of 23 grams per second minimum will be filled in with the arrangement shown on FIG. 1. Sufficient medium, e.g., propellant, is filled in, based on the size of the container, to establish an operating pressure of 30 to 70 psig. Once the stem is allowed to return to its normal position, at the end of pressure filling after a measured amount has been filled in, gasket 49 resumes its normal position sealing against the wall of the valve body 11 to prevent propellant from reaching the tank area and escaping.

Figure 3:
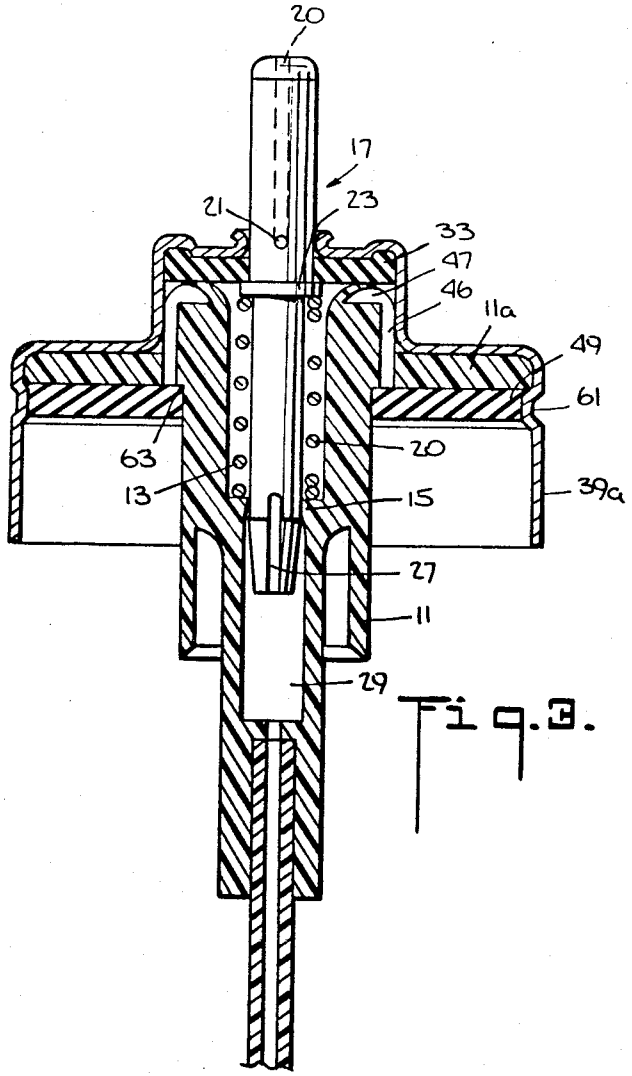
FIG. 3 is a cross-sectional view of a metering valve according to the present invention.

The normal unoperated position of the metering valve is illustrated by the valve of FIG. 3. This valve is of a slightly different construction but contains all the same essential features. One of the differences is that, in this arrangement valve body 11 includes a flange **11*a* which snaps into mounting cup 39*a* in which suitable detents 61 are formed. In the embodiment illustrated here, spring 20 is biasing stem 17 upward so that flange 23 is resting against diaphragm 35. As illustrated, the radial port 21 is now above diaphragm 35 so that no communication is established between outlet bore 20 and the tank 13. In the position shown, the slots 27 in the bottom portion 25 of valve stem 17 bridge the throat 15 permitting material to pass from the chamber 29 into tank 13. Material will also fill the slots 47 and channels 46. However, material will not get past the gasket 49 nor will the pressure medium within the container move upward past gasket 49. It should be noted that, in this position, the pressure on both sides of gasket 49 is essentially equal. When it is desired to discharge, stem 17 is pressed downward. As this occurs, the channels 27 will move below the throat 15 preventing any additional material from reaching the tank 13. Thereafter, port 21 will move below diaphragm 35 placing the outlet bore 20 in communication with tank 13. The material stored in tank 13, which will be under pressure, will then be forced out and dispensed. When this occurs, there will be a differential pressure at the two sides of gasket 49. The portion of gasket 49 adjacent channel 46 will essentially reach atmospheric pressure whereas the other side of gasket 49 will be exposed to the pressure within the container. However, because of the large area of flange 11*a* or, in the case of embodiment of FIG. 1, of the mounting cup, most of this pressure will act against a solid surface. The remaining pressure will not be sufficient to deform the gasket upward. This is due to the tight seal which is formed and the fact that the pressure differential, which will be at the most 70 psig, is an order of magnitude lower than the pressure needed for pressure filling. In addition, in the embodiment shown a step 63 is formed in the valve body 11 and the edge of gasket 49** abuts thereagainst further preventing upward movement thereof.

Figure 4:
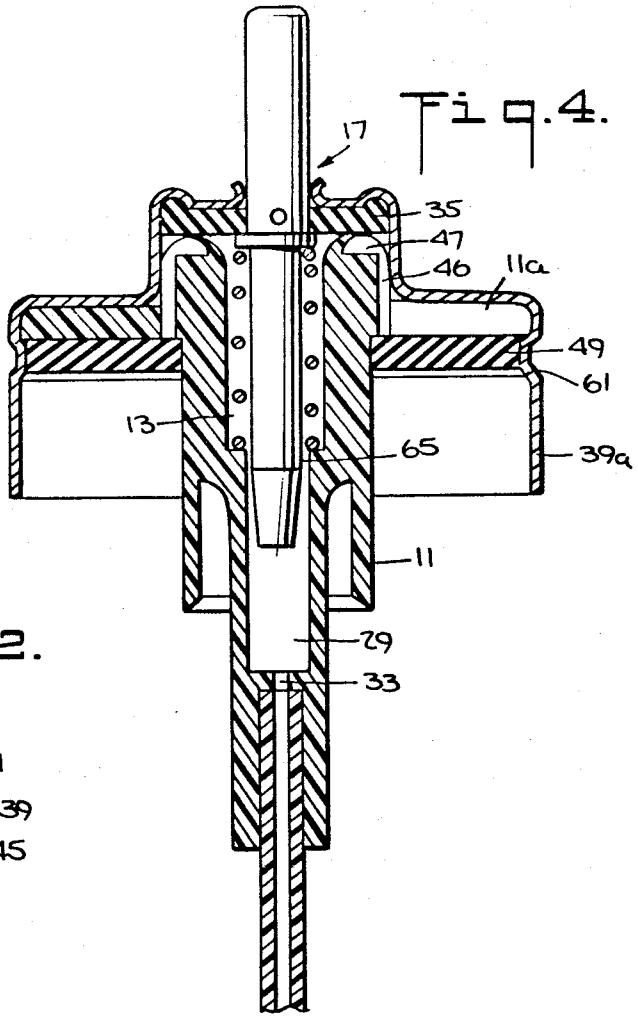
FIG. 4 is a cross-sectional view of a non-metering valve according to the present invention.

The two embodiments just described are metering valves. That is, the throat 15 closes off the tank 13 from the container when the stem 17 is depressed. FIG. 4 illustrates a non-metering valve having a construction identical to that of FIG. 3 with the one exception; it does not contain a throat 15 and passages 27 to bridge the throat. Thus, there is at all times gap 65 between the valve body 11 and the valve stem 17 so that material in the chamber 29 can always reach the tank 13. Although, in this embodiment, during pressure filling, material can flow from the tank through the gap 65 into the chamber 29 and then through the orifice 33 into the container, advantages are still obtained with the present invention. The orifice 33 is a limiting orifice and in some types of valves is made quite small. In such cases, filling through this orifice could take an unduly long time. Thus, even with a standard valve, i.e., a non-metering valve, the present invention offers advantages in pressure filling.

Figure 5:
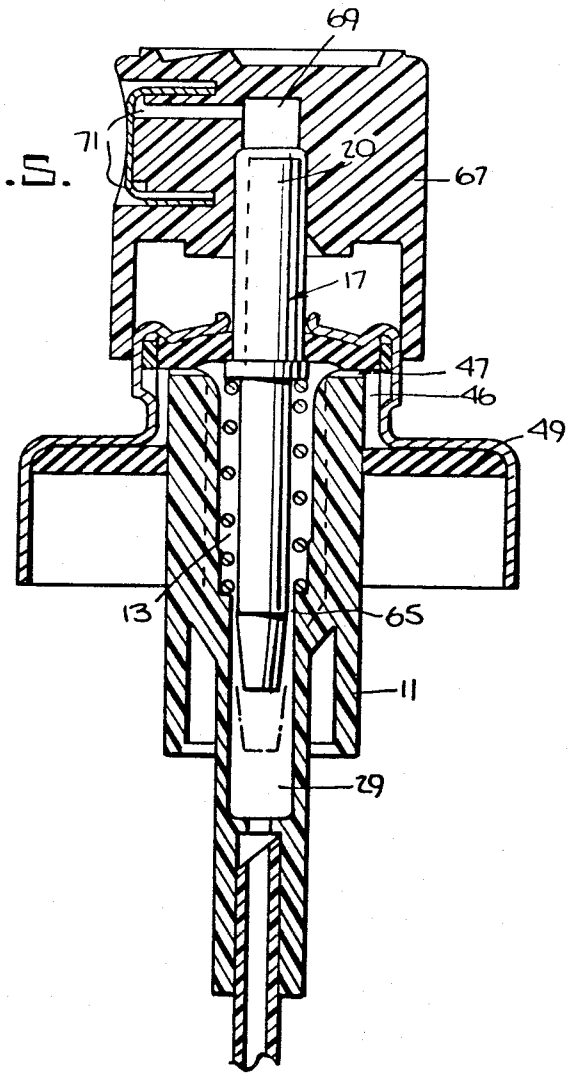
FIG. 5 is a similar view of another non-metering valve.

FIG. 5 shows a standard, non-metering valve of construction essentially the same as the construction of the valve of FIG. 1 with the exception, again, that it contains no throat but instead always forms a gap 65 to permit communication between the tank 13 and the chamber 29. As in the other embodiments, it contains the channels 46 and slots 47 to permit fast pressure filling. This valve is also shown with an actuator 67 mounted on to the top portion 19 of the stem 17. Material expelled through the bore 20 enters a chamber 69 in the actuator from which it is then directed outward through channels 71 in conventional fashion.

In the embodiment of FIG. 1, pressure filling took place both through and around bore 20 and port 21. The pressure filling head can be modified so as to supply the propellant only through or only around the stem 17.

Figure 6:
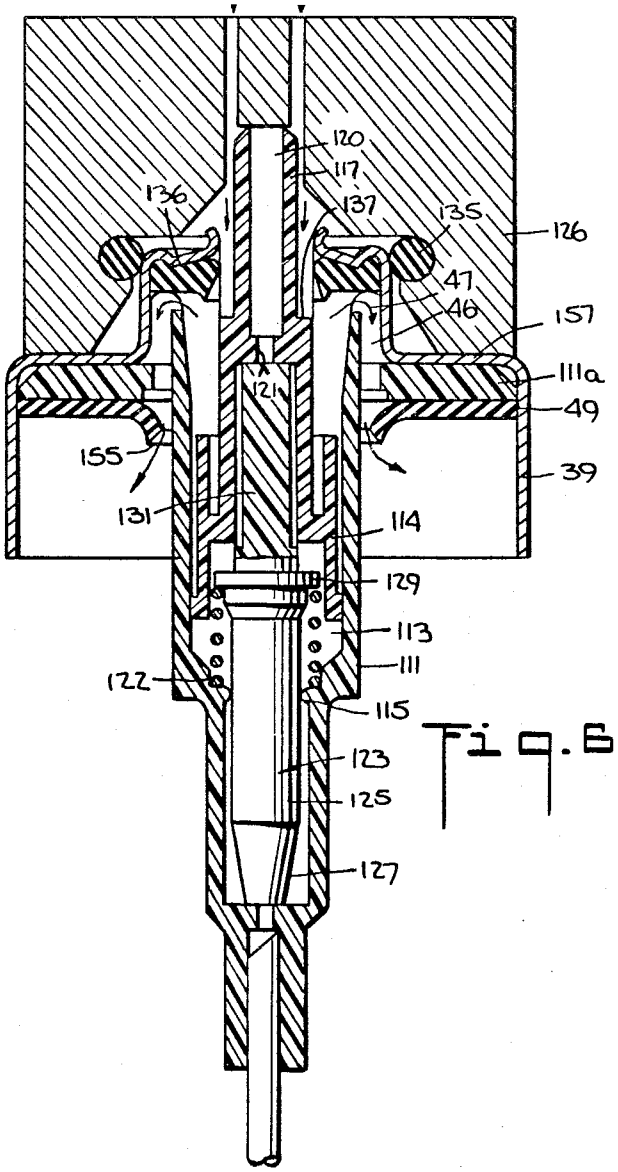
FIG. 6 is a cross-sectional view of a pump constructed according to the present invention, during pressure filling.

A pressure filling arrangement with filling only around a stem is shown on FIG. 6 in connection with a leak proof pump. This pump is a prepressurized pump of the general type disclosed in copending application Ser. No. 765,701. Unlike the pump disclosed therein, which is vented, this pump is sealed airtight and the container must be pressurized. This method of pressure filling of the present invention is applicable to any type of pump which is a leak proof pump which contains material under pressure to avoid the need for venting. This device is particularly useful in the dispensing of products which cannot tolerate the presence of air such as certain sensitive drugs. This pump type pressurized container, generally utilizes compressed gas such as nitrogen, etc. as the propellant.

The construction of the pump body 111 is quite similar to the construction of the valve body 11 of FIG. 3. The pump body 111 contains a flange 111*a* which fits into the mounting cup 39 which, though not shown, can have detents 64 such as shown in FIG. 3. At the top of the pump body 111, radially disposed slots 47 and vertically disposed channels 46 are formed leading to the space above a gasket 49.

Disposed within the tank or chamber 113 within the pump body 111 is a piston 114 on the end of a stem 117. In this type of pump, the stem and piston form an integral assembly. At the bottom of the chamber 113 is a throat 115. A valve member 123 has a lower portion 125 which extends through and is in sealing contact with the throat 115 in the position shown. The lower portion 125 has tapered section 127 at its bottom. The stem 117 contains a central bore 120 in communication with an axial port 121. Directly above the lower portion 125 of the valve member 123 is a flange 129 and above that, an upper valve portion 131. A spring 122 is disposed between the bottom of the chamber 113 and the flange 129, biasing the valve member 123 upward. This tends to bias the upper portion 131 against the port 121 to keep it closed. The pump is shown in a position where it is fully depressed by a pressure filling head 126. Pressure filling head 126 (shown in FIG. 6), contains an annular bore 133 of a diameter greater than the outer diameter of the stem 117. Directly below the bore is a recess containing a sealing gasket 135. As shown, the sealing gasket seals around the upper portion of the mounting cup 39. The pressure filling head comes down and rests on the flat part 157 of the mounting cup. The stem 117 is formed with a reduced diameter near its top. Thus, below the place where a step 137 is formed, stem 117 has a larger diameter. This diameter is essentially equal to or slightly greater than the diameter of a diaphragm 136 which is interposed between the pump body 111 and the mounting cup 39. In the position shown, the portion of the stem 117 of reduced diameter is below the diaphragm 136. This opens a path into the inside of the pump body above the piston 114. During pressure filling, material passes through the annular bore 133 alongside the stem 117 and into the pump body 111 and from there, through the channels 46 and slots 47 to the gasket 49. This gasket is constructed in the same manner described above, i.e., it should have the same characteristics with respect to the matching of the hole therein to the body 111, the smoothness of the inner surface 155, the compressibility of material and degree of compression when it is crimped onto a glass or metal bottle. In the manner explained above, the pressure used during pressure filling pushes the edge of gasket 49 away from the pump body 111 permitting the propellant to pressure fill into the container. Once pressure filling is complete the pressure in the container will push the ends 155 upward to seal against the pump body 111. Once again, as in the aerosol valve embodiment, the diaphragm 136 does seal against the mounting cup but does not seal against the top of the pump body 111.

Once the pressure filling head 126 is removed, spring 122 will bias the valve member 123, the piston 114 and the stem 117 upward so that the top 141 of the piston will come to rest against the diaphragm 136. In this position, the diaphragm will also be sealing around the portion of the stem 117, below the step 137, this portion being of a larger diameter. The primary seal is maintained at the gasket 49. However, the diaphragm 136 provides additional sealing under these conditions. In this raised position, the tapered portion 127 of the valve member 123 will be at the throat opening a gap so that, as the piston moves upward, creating a partial vacuum, the pressure of the compressed as, will force the fluid through a dip tube 143 and an orifice 145 into a chamber 147 and thence through the throat 115, around the tapered portion 127 of the stem into the pump chamber 113.

In operation, when the stem is depressed, initial motion of the stem and the valve member 123 therewith creates a seal between the lower portion 125 of the valve member and the throat 115. Pressure then builds up within the pump chamber 113. Since the pressure acts over a larger area downward than upward on valve member 123, a net downward force results which eventually overcomes the force of the spring 122 causing the valve member 123 to move downward away from the port 127 to permit dispensing through the port and the bore 120. Normally, a conventional actuator such as that shown in FIG. 5 will be disposed over the stem 117.

Figure 7:
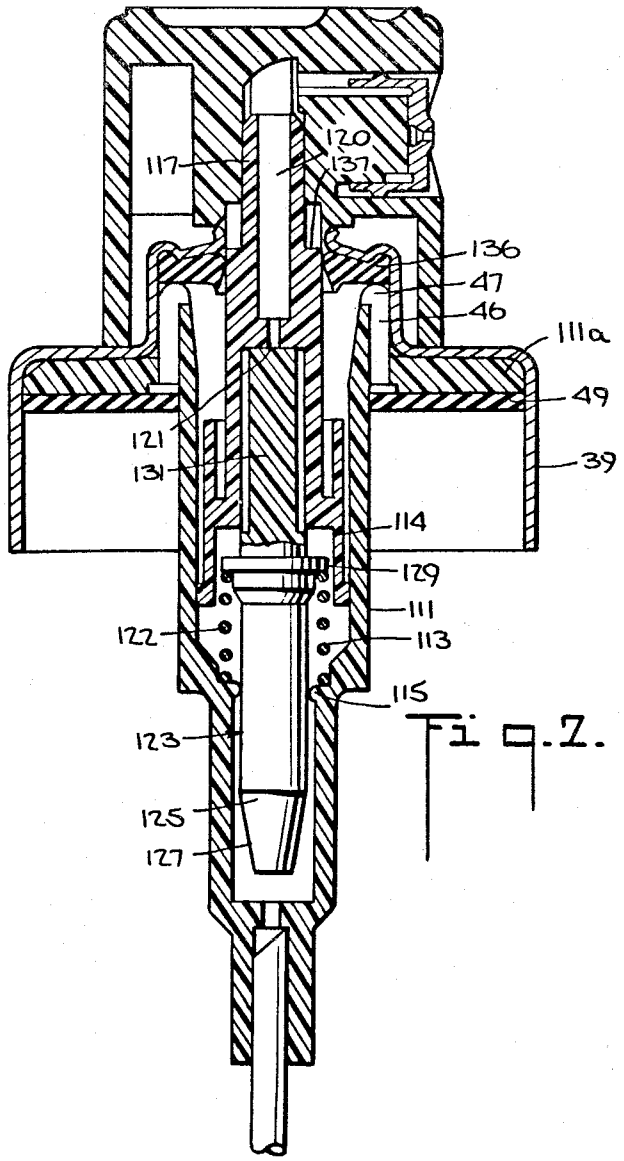
FIG. 7 is a similar view of the pump of FIG. 6 during dispensing.

Preferably, an actuator such as actuator 170 shown on FIG. 7 is used. The pump is shown at the end of a dispensing stroke. The actuator includes an annular sleeve 169 which comes down to rest on the top, or flat part 157, of the mounting cup 39. This limits the travel of the piston 114 and particularly of the stem 117 so that the step 137 remains above the diaphragm 136. Furthermore, this arrangement, through the use of different depths of annular sleeve 169, permits controlling the dosage of the pump. In other words, if a small dosage is desired, the annular sleeve 169 can be made longer. Thus, in effect, the same pump can be adapted to dispense different dosages.

Figure 8:
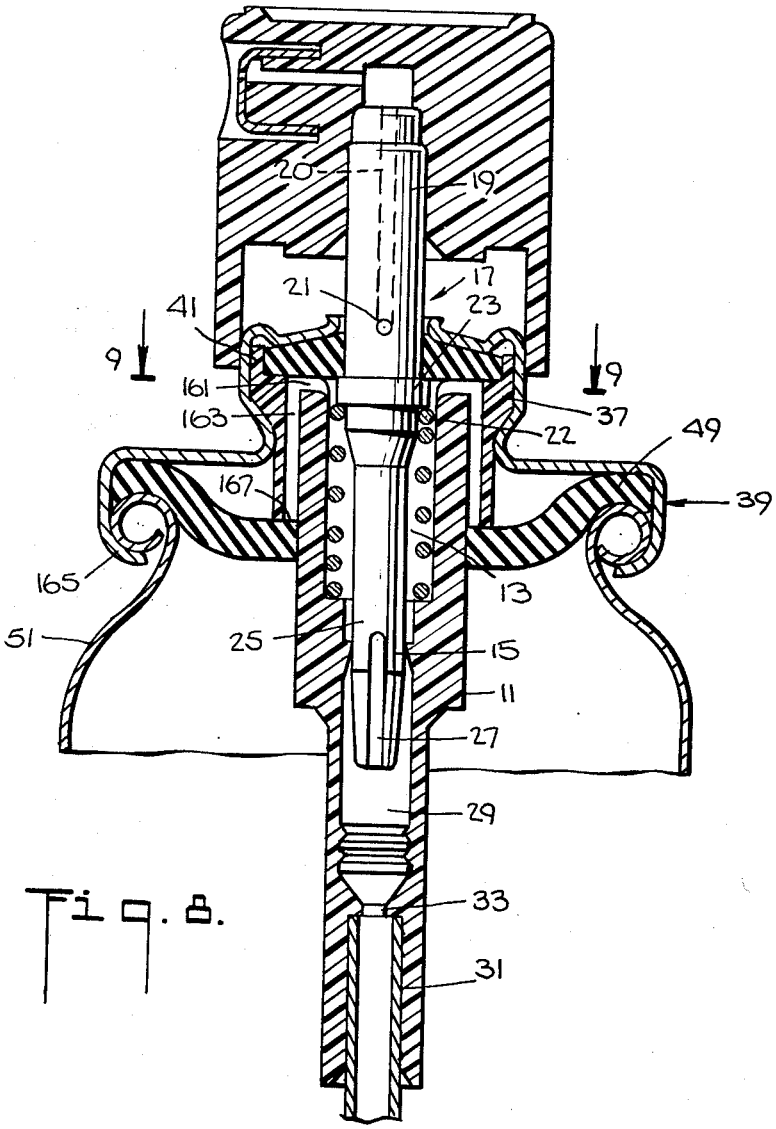
FIG. 8 is a cross-sectional view of an alternative embodiment of a metering valve according to the present invention.
Figure 9:
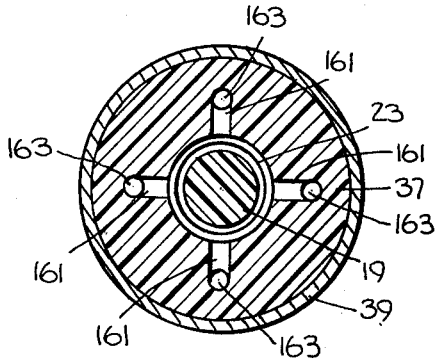
FIG. 9 is a plan view of the top of the valve of FIG. 8.

FIGS. 8 and 9 show an alternative embodiment of a metering valve to that of FIG. 1. The metering valve of FIGS. 8 and 9, is mounted on a container 51, shown here as made of metal, and is held in place by means of a crimp 165 in metal mounting cup 39. (Where possible, the parts shown in FIGS. 8 and 9 are marked with the same reference numbers as were used in the preceding figures.) The main portion of measuring tank 13 is located centrally in a valve body 11 through which a valve stem 17 passes axially. The valve stem 17 has an upper portion 19 which contains, as before, an axial bore 20 which communicates with a radial port or orifice 21. A flange 23 is formed on valve stem 17 directly below upper portion 19 of the valve stem. Valve stem 19 also has a lower portion 25 which seals against the sealing throat 15 during operation. Spring 22 acts between the bottom of tank 13 and flange 23, biasing stem 17 towards the outside of the assembly.

In FIG. 8, the valve is shown in its normally closed position, with orifice 21 positioned above the bottom of diaphragm 35 so that communication between axial bore 20 and the interior of the valve is cut off. Diaphragm 35, as before, surrounds the top portion of stem 19, being held in place by the turned over, reduced diameter, upper portion of the mounting cup 39, and being received in a cup defined by annular wall 41 on enlarged portion 37 of valve body 11. Valve body 11 is also held in place in mounting cup 39 by the reduced diameter of mounting cup 39 which conforms to the tapered mid-section contour of the enlarged upper valve body portion 37. In this embodiment of the invention, the top 43 of valve body 11 is flat and contains a number of slots 161, each of which extends radially from the wall of tank 13 to a point part way towards the outer cylindrical surface of enlarged upper body portion 37 where it connects with a hole 163. This arrangement may also be seen in FIG. 9. Each hole 163 runs through the enlarged upper part of body 37 to a circumferential downward facing, lip or step surface 167. The bottom ends of holes 163, where they terminate on step 167 are normally closed by the upper, flat surface of gasket 49 which seats against the step. While the channels formed by the connected slots 161 and holes 163 may be constructed as shown, it will be understood that other cross-sectional shapes and path locations may be employed.

Gasket 49 is constructed of the same materials as were described above and serves to effectively seal off the space within container 51 from bottom ends 167 and thus prevent reverse flow of the medium from the container into holes 163.

The remaining portions of the metering valve of FIG. 8 include a lower valve body portion having a reduced diameter compared with the central portion of the valve body on which gasket 49 is seated. Valve stem 17 travels in the lower end, as before. Dip tube 31 communicates with the lower end through orifice 33.

Operation of the valve of FIGS. 8 and 9 is similar to that of, for example, the valve of FIG. 1. However, during the filling operation, inflowing material now travels through holes 163 within valve body 11, instead of passing down channels on the outside of the valve body. As before, during filling, pressurized filling material flows in through axial bore 20 and radial port 21, the valve stem being depressed so that the orifice is located below diaphragm 35, out of the orifice and into the space surrounding upper valve stem 19. Thence it flows through slots 161 and vertical holes 163 in enlarged valve body portion 37. Leaving holes 166, it presses against the upper surface of gasket 49, forcing it away from the outside wall of the valve body 11; thence it continues into the space within container 51. Upon completion of the filling operation, gasket 49 seats itself on step 167 of body 11, and is maintained there by the pressure of the fill.

The structure of FIGS. 8 and 9 has the particular advantage that the volume of material which is trapped within the space defined by tank 13, slots 161 and vertical holes 163 is substantially reduced, compared to that of FIG. 1, for example. Thus, much smaller measured doses can be metered out. This structure also improves the accuracy, by weight, of each dose and can be used in valves for metering very small doses, of the order of 50 mcl. or less.

The size of the dose can readily be fixed, at the time of manufacture, by correct choice of the diameter and the number of ports. The seal provided by gasket 49 where it seats on the lip or surface 167 of the enlarged portion 37 acts as the valve seal for the valve when it is crimped on the container, and provides a boundary for the entrapped volume.

What is claimed is:

1. In a pressurized dispenser comprising: a container; a mounting cup having a central opening therein, said mounting cup attached to said container; a dispensing means comprising a body member forming a tank and having an open top portion with a dispensing stem projecting therefrom through said central opening in said mounting cup, said body retained in said mounting cup; and a diaphragm interposed between said body and said mounting cup, sealing around said projecting stem at least when said stem is in an unoperated position, the improvement comprising:

(a) a passageway formed in said body extending across the top of and through said body, said passage in communication with the tank in the area below the diaphragm;

(b) an annular gasket interposed between said mounting cup and said container, said gasket having an opening with the same profile as the outside of said body disposed so as to seal against said body to interrupt communication between said passageway and said container; and (c) means to permit a pressure medium to be supplied to the area of said tank below said diaphragm whereby, when a medium is supplied under high pressure to the area below said diaphragm it will have a free path across the top of said body and along the side thereof to said gasket, will deform said gasket away from the side of said body permitting flow into said container and whereby, after said medium at high pressure is removed, the pressure remaining inside said container will push said gasket upward into sealing contact with said body to prevent leakage of said medium from said container.

2. The improvement according to claim 1 wherein said dispenser comprises an aerosol dispensing valve, said dispensing stem including a central bore therethrough and a radial port at the inside end of said port, which, when in an at rest position, is above the bottom edge of said diaphragm and, when in an operated position, is in communication with said tank, and wherein said means to permit a medium to be supplied to the said tank below said gasket comprises said annular bore and radial port.

3. The improvement according to claim 2 wherein said aerosol valve comprises a metering valve.

4. The improvement according to claim 2 wherein said aerosol valve comprises a non-metering valve.

5. The improvement according to claim 2 wherein said dispenser comprises a non-vented pump having a piston operatively coupled to said dispensing stem and wherein said means to permit a pressure medium to be supplied comprise means for conducting a medium, under pressure, to the space below said diaphragm and above said piston.

6. The improvement according to claim 5 wherein said stem has an upper portion of diameter smaller than the size of the opening in said diaphragm whereby movement of said stem downward will open a gap between said stem and said diaphragm.

7. The improvement according to claim 6 and further including an atomizer on said dispensing stem, said atomizer having a downwardly depending flange of a length such that, during operation, said flange contacts said mounting cup before said upper portion of said stem passes through said diaphragm.

8. The improvement according to claim 1 wherein said valve body further includes a flange, said flange disposed between said mounting cup and said gasket and further including openings in said flange forming a continuation of said passageway.

9. The improvement according to claim 8 and further including detents formed in said mounting cup for retaining said flange.

10. The improvement according to claim 1 and further including an outward step formed in said body directly above the point of contact of the upper edge of said gasket with said body.

11. The improvement according to claim 1 wherein said gasket has a durometer of 50 to 70.

12. The improvement according to claim 1 wherein said passage lies along the side of said body.

13. The improvement according to claim 1 wherein said passage extends through holes in said body.

14. A method of constructing a pressurized dispenser comprising:

(a) forming a dispenser body containing a tank, said body having an open top and having a dispensing stem extending therefrom;

(b) forming a passageway across the top of said body;

(c) disposing said body in a mounting cup with a diaphragm between said body and said mounting cup, said diaphragm acting to seal about said dispensing stem at least when said dispenser is in an unoperated condition;

(d) extending said passageway in the top of said body and along the length thereof;

(e) disposing said mounting cup on the open end of a container with a gasket interposed between said mounting cup and said container, said gasket having an opening therein of the same size and profile as said body so as to seal thereabout; and (f) securing said mounting cup onto said container whereby a flow path for a pressuring medium will be established over the top of said body and along the length thereof to said gasket, permitting said medium to deform said gasket downward to pressure fill said container, whereupon, after said pressure is removed, the pressure inside said container will cause said gasket to again seal about said body to prevent leakage of said medium from said dispenser.

15. The method according to claim 14 and further including, admitting a medium at high pressure to the area in said tank below said diaphragm.

16. The method according to claim 15 comprising admitting said medium to said tank both through and around said stem.

17. The method according to claim 15 wherein said medium is admitted at a pressure of approximately 800 psig with an amount of medium admitted so as to pressurize said container up to 70 psig.

18. The method according to claim 14 wherein said gasket is selected to have a durometer of 50 to 70 and is formed with a smooth inside surface and with an opening closely matching the profile of said body.

19. The method according to claim 18 and further including using a container having no sharp edges at its open end.

20. The method according to claim 14 wherein said step of securing comprises securing so as to obtain a 10 to 25% compression of said gasket, thereby forcing said gasket inward and into a more intimate sealing relationship with said body.

21. The method according to claim 2 wherein said step of securing comprises crimping said mounting cup to said container.

22. In a dispenser having a body forming a tank, an actuator and stem, and a mounting cup with a flexible diaphragm sealing against the stem, body and mounting cup and a sealing gasket sealing between the container and the mounting cup, the improvement comprising: the tank having channels across the sealing area underneath the diaphragm, leading to the outside diameter of the tank, permitting the free flow of fluids, while the container is being pressure filled, the liquid passing through said channels to said sealing gasket, which is annular and which is normally sealed against the outside diameter of the tank, whereby only under the pressure during filling, the sealing gasket flexes, permitting the fluid to flow into the container.

23. The dispenser of claim 22 in which said channels extend from the area underneath the diaphragm through said tank to said sealing gasket.

24. The dispenser of claim 23 in which said channels extend from the area underneath the diaphragm through holes in said tank to said sealing gasket.

25. The dispenser of claim 23 in which said channels extend from the area underneath the diaphragm along the side of said tank to said gasket.

* * * * *

UNITED STATES PATENT AND TRADEMARK OFFICE

CERTIFICATE OF CORRECTION

PATENT NO. : 4,271,875

DATED : June 9, 1981

INVENTOR(S) : Philip Meshberg

It is certified that error appears in the above—identified patent and that said Letters Patent is hereby corrected as shown below:

Col. 4, line 62, change "semiconductor" to --semicircular--.

Col. 5, line 5, after "of", insert --the--.

Col. 5, line 10, after "of", delete --the--.

Col. 5, line 20, change "gasekt" to --gasket--.

Col. 8, line 31, change "as" to --gas--.

Col. 9, line 62, change "166" to --163--.

Col. 12, line 29, change "2" to --20--.

Signed and Sealed this

*Twenty-second* Day of *September 1981*

[SEAL]

*Attest:*

GERALD J. MOSSINGHOFF

*Attesting Officer*

*Commissioner of Patents and Trademarks*